US009291991B2

(12) United States Patent
Yoshida

(10) Patent No.: US 9,291,991 B2
(45) Date of Patent: Mar. 22, 2016

(54) IMAGE FORMING APPARATUS

(71) Applicant: CANON KABUSHIKI KAISHA, Tokyo (JP)

(72) Inventor: Keisuke Yoshida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/277,505

(22) Filed: May 14, 2014

(65) Prior Publication Data

US 2014/0348542 A1 Nov. 27, 2014

(30) Foreign Application Priority Data

May 22, 2013 (JP) ..... 2013-107915

(51) Int. Cl.

*G03G 15/16* (2006.01)
*G03G 21/16* (2006.01)
*G03G 15/20* (2006.01)

(52) U.S. Cl.

CPC ..... *G03G 21/1685* (2013.01); *G03G 15/2032* (2013.01); *G03G 15/2067* (2013.01); *G03G 15/2089* (2013.01); *G03G 2215/2035* (2013.01)

(58) Field of Classification Search

CPC ..... G03G 15/2089; G03G 15/2032; G03G 15/2067; G03G 21/1685
USPC ..... 399/122
See application file for complete search history.

(56) References Cited

U.S. PATENT DOCUMENTS

2012/0219324 A1* 8/2012 Masuda ..... 399/122
2013/0142526 A1* 6/2013 Numazu et al. ..... 399/21
2013/0142552 A1 6/2013 Yoshida
2014/0161479 A1 6/2014 Yoshida et al.

FOREIGN PATENT DOCUMENTS

JP 10-301432 A 11/1998

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes an image forming device configured to form a toner image on a sheet, a fixing device, including first and second rotatable members, for forming a nip, configured to fix the toner image formed on the sheet by the image forming device, a mounting portion to which the fixing device is detachably mountable substantially along a longitudinal direction thereof, a pressing mechanism configured to press the first rotatable member toward the second rotatable member by entrance thereof, along a direction substantially perpendicular to the longitudinal direction, into a space of the mounting portion through which the fixing device passes during mounting and demounting, and a retracting mechanism configured to retract the pressing mechanism from the space.

12 Claims, 13 Drawing Sheets

IMAGE FORMING APPARATUS

FIELD OF THE INVENTION AND RELATED ART

The present invention relates to an image forming apparatus, such as a copying machine, a printer, a facsimile machine or a multi-function machine having functions of these machines, in which a fixing device is detachably mountable to a main assembly of the image forming apparatus and in which an image is formed on a sheet.

In a conventional image forming apparatus of an electrophotographic type, a constitution in which a toner image is formed on a sheet by an image forming device and then is fixed on the sheet by a fixing device is employed.

Such a fixing device is replaced once or plural times as a maintenance replacement until an image forming apparatus main assembly reaches the end of its lifetime in some cases (Japanese Laid-Open Patent Application (JP-A) Hei 10-301432). Further, in recent years, viewpoints such as resource saving and reduction in running cost are regarded as importance, and it is preferable that a whole of the fixing device is not subjected to the replacement part, but a part of components constituting the fixing device is used as it is in the apparatus main assembly.

In these circumstances, as a member which is not subjected to the maintenance part, there is a pressing mechanism for pressing a pair of rotatable members to form a nip for heating the toner image on the sheet.

SUMMARY OF THE INVENTION

According to an aspect of the present invention, there is provided an image forming apparatus comprising: an image forming device configured to form a toner image on a sheet; a fixing device, including first and second rotatable members for forming a nip, configured to fix the toner image formed on the sheet by the image forming device; a mounting portion to which the fixing device is detachably mountable substantially along a longitudinal direction thereof; a pressing mechanism configured to press the first rotatable member toward the second rotatable member by entrance thereof, along a direction substantially perpendicular to the longitudinal direction, into a space of the mounting portion through which the fixing device passes during mounting and demounting; and a retracting mechanism configured to retract the pressing mechanism from the space.

According to another aspect of the present invention, there is provided an image forming apparatus comprising: an image forming device configured to form a toner image on a sheet; a fixing device, including first and second rotatable members for forming a nip, configured to fix the toner image formed on the sheet by the image forming device; a pressing mechanism configured to press between the first and second rotatable members; a mounting portion to which the fixing device is detachably mountable substantially along a longitudinal direction thereof; and a moving mechanism configured to move the pressing mechanism so as to be movable to first position where the pressing mechanism presses between the first rotatable member and the second rotatable member by entrance thereof, along a direction substantially perpendicular to the longitudinal direction, into a space of the mounting portion through which the fixing device passes during mounting and demounting, and movable to a second position where the pressing mechanism is retracted from the space.

According to another aspect of the present invention, there is provided an image forming apparatus comprising: an image forming device configured to form a toner image on a sheet; a fixing device, including first and second rotatable members for forming a nip, configured to fix the toner image formed on the sheet by the image forming device; a mounting portion to which the fixing device is detachably mountable substantially along a longitudinal direction thereof; a pressing mechanism configured to press the first rotatable member toward the second rotatable member by entrance thereof, along a direction substantially perpendicular to the longitudinal direction, into an overlapping region with the fixing device when the fixing device mounted the mounting portion is viewed substantially along the longitudinal direction; and a retracting mechanism configured to retract the pressing mechanism from the overlapping region.

According to a further aspect of the present invention, there is provided an image forming apparatus comprising: an image forming device configured to form a toner image on a sheet; a fixing device, including first and second rotatable members for forming a nip, configured to fix the toner image formed on the sheet by the image forming device; a pressing mechanism configured to press between the first and second rotatable members; a mounting portion to which the fixing device is detachably mountable substantially along a longitudinal direction thereof; and a moving mechanism configured to move the pressing mechanism so as to be movable to first position where the pressing mechanism between the first rotatable member and the second rotatable member by entrance thereof, along a direction substantially perpendicular to the longitudinal direction, into an overlapping region with the fixing device when the fixing device mounted the mounting portion is viewed substantially along the longitudinal direction, and movable to a second position where the pressing mechanism is retracted from the overlapping region.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment (1) Image Forming Device

Figure 1:
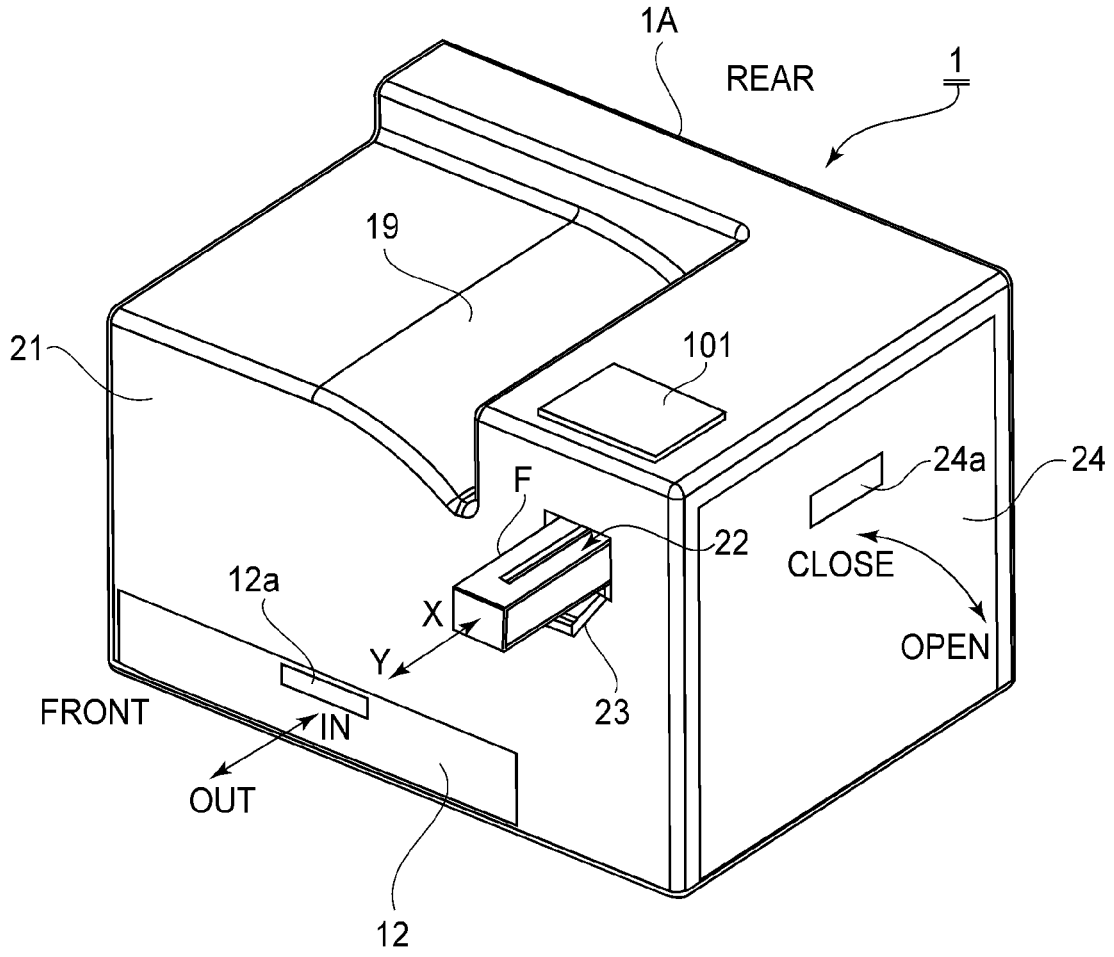
FIG. 1 is a perspective view of an outer appearance of an image forming apparatus in Embodiment and shows a halfway state in which a fixing device is partly pulled out by front access or is partly inserted for mounting.
Figure 2:
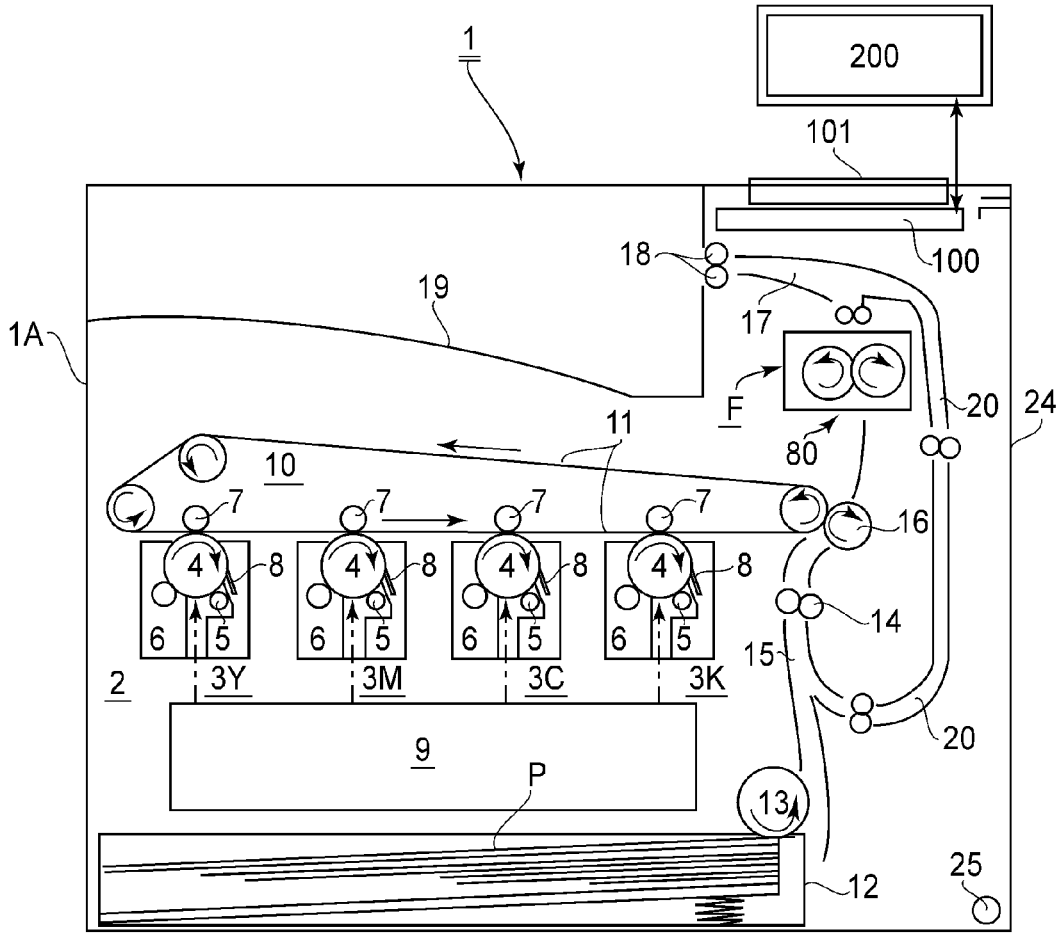
FIG. 2 is a longitudinal-sectional front view of the image forming apparatus.

FIG. 1 is a perspective view of an outer appearance of an example of an image forming apparatus 1 according to the present invention. With respect to this image forming apparatus 1, a fixing device F is detachably mountable to a fixing device mounting portion 80 (FIG. 2) provided inside an image forming apparatus main assembly 1A. FIG. 1 shows a halfway state in which the fixing device F is partly pulled out from the mounting portion 80 of the apparatus main assembly 1A by front access or is partly inserted into the mounting portion 80 for mounting. FIG. 2 is a longitudinal sectional front view of the image forming apparatus 1.

Here, with respect to the image forming apparatus 1 or constituent members thereof in this embodiment, a front surface or a front side is a side where a sheet cassette 12 accommodating sheets (recording material) P is inserted into and pulled out from a cassette mounting portion of the apparatus main assembly 1A. A rear surface side or a rear side is an opposite side to the front (surface) side. Left and right are those when the image forming apparatus 1 is viewed from the front side. Up (above) and low (below) are those with respect to a direction of gravitation.

The image forming apparatus 1 is a color printer capable of forming an image, on the sheet by an electrophotographic process of a transfer type, corresponding to electrical image information inputted into a control circuit portion 100 from an external host device 200 such as a personal computer, an image reader or a facsimile machine. The sheet P is a sheet member capable of forming thereon a toner image by the image forming apparatus 1, and includes regular or irregular various plain papers, resin-coated paper, OHP sheet, printing sheet, formatted paper, envelope, post card, label and the like.

An image forming device 2 is provided inside the apparatus main assembly 1A and includes four image forming stations 3Y, 3M, 3C and 3K which are arranged from left to right. Each of the image forming stations includes a rotatable drum-type electrophotographic photosensitive member 4, a charging member 5, a developing device 6, a transfer member 7 and a photosensitive member cleaner 8, and the image forming stations 3Y, 3M, 3C and 3K form toner images of yellow, magenta, cyan and black, respectively. Further, the image forming device 12 includes a laser scanner 9 for subjecting the respective image forming stations to laser scanning exposure and includes an intermediary transfer belt 10 onto which the toner image is to be primary-transferred from the photosensitive member 4 *o* each of the image forming stations.

From a sheet cassette 12, one of sheets P is separated and fed by drive of a feeding roller 13 and then is fed from below to above by an upward (vertical) feeding path 15 including a registration roller pair 14. Then, the sheet P is introduced into a secondary transfer nip formed by the intermediary transfer belt 10 and a secondary transfer roller 16. As a result, synthetic toner images obtained by primary-transferring superposedly the respective color toner images from the respective image forming stations 3Y, 3M, 3C and 3K onto the intermediary transfer belt 11 are successively secondary-transferred onto the sheet P. A constitution, an operation and an image forming process of the image forming device described above are well known, and therefore are omitted from detailed description.

The sheet P coming out of the secondary transfer nip is separated from the intermediary transfer roller 10 and then is introduced into the fixing device F from below. The sheet P is nipped and fed through a nip formed by a fixing member (heating member) and a pressing member which are described later, so that the toner images are heat-fixed. Then, the sheet P is fed upward from the fixing device F and passes through a feeding path 17, and then is discharged as an image-formed product onto a discharge tray 19, by a discharging roller pair 18, provided in an upper surface side of the apparatus main assembly 1A.

An operation in a both-sided image forming mode is as follows. Until a trailing end of the sheet P, on which the image has been formed on a first surface, to be discharged toward the discharge tray 19 by the discharging roller pair 18 after coming out of the fixing device F and passing through the feeding path 17 comes out of the fixing device F and then completely passes through the discharging roller pair 18, a driving (rotational) direction of the discharging roller pair 18 is reversely switched. As a result, the sheet P is switched back and fed into a feeding path 20 and then is fed again toward the secondary transfer nip via the upward feeding path 15 in an upside down state. Thereafter, the sheet P is fed along the same feeding path as in the case of a one-side image forming mode, so that the sheet P on which the images have already been formed on first and second surfaces (both sides) is discharged onto the tray 19.

In FIG. 1, the sheet cassette 12 is capable of being pulled out and inserted into a cassette mounting portion in the apparatus main assembly 1A from the front side, of the image forming apparatus 1, where a front (surface) plate 21 of the apparatus main assembly 1A is provided (front loading). The sheet cassette 12 is provided with a grip portion 12*a* at a front surface portion. The front plate 21 is provided with an opening 22 for permitting mounting and demounting of the fixing device F, and is also provided with a door 23 for being opened and closed relative to the opening.

A side door 24 is provided on a right-side surface of the apparatus main assembly 1A and is openable and closable relative to the right-side surface of the apparatus main assembly 1A about a lower-side hinge shaft 25. The side door 24 is provided with a grip portion 24*a*. By opening the side door 24, a right-side surface of the apparatus main assembly 1A can be largely opened. As a result, the jammed sheet P in the sheet feeding paths 15, 17 and 20 and the fixing device F can be cleared (processed). An operating portion 101 is provided in an upper-surface side of the apparatus main assembly 1A and includes various information input keys and a displaying device, thus transferring various pieces of information with the control circuit portion 100. The control circuit portion 100 controls all device operations of the image forming apparatus 1.

(2) Fixing Device F (2-1) Device Structure

Figure 3:
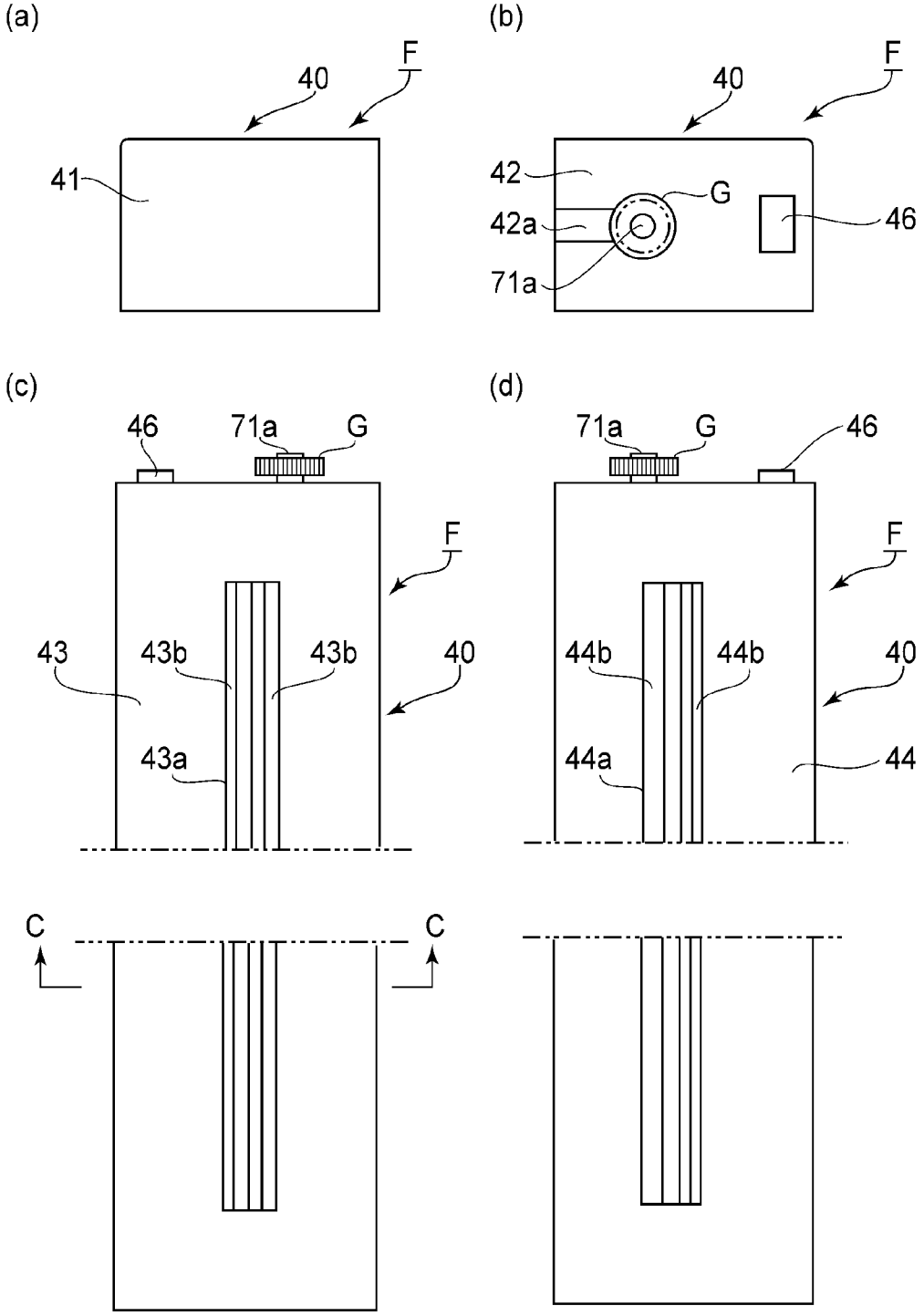
In FIG. 3, (a) is a front view of the fixing device in Embodiment, (b) is a rear view of the fixing device, (c) is a plan (top) view of the fixing device from which a halfway portion is omitted, and (d) is a bottom view of the fixing device from which the halfway portion is omitted.
Figure 4:
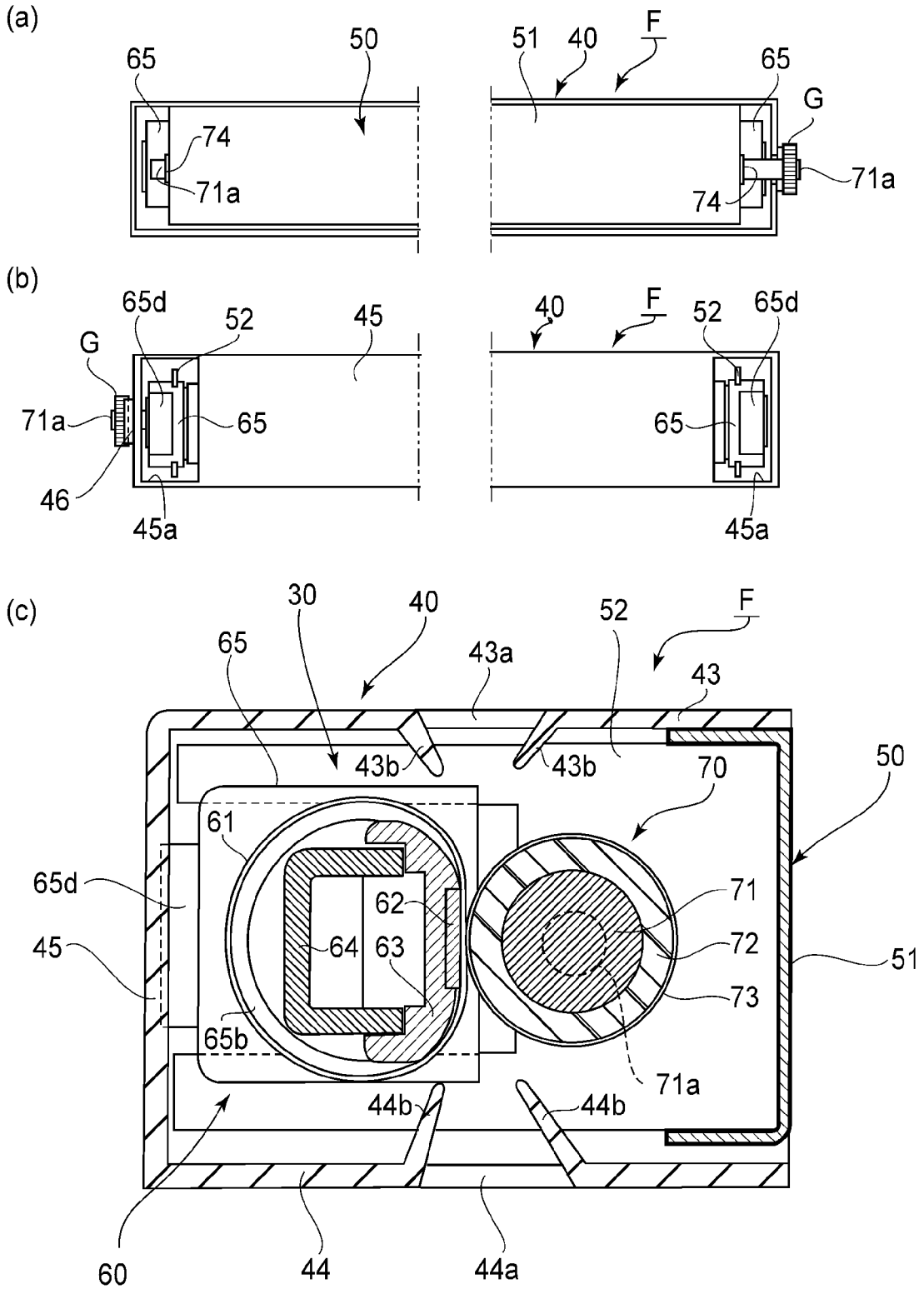
In FIG. 4, (a) is a right side of the fixing device from which a halfway portion is omitted, (b) is a left side view of the fixing device from which the halfway portion is omitted, and (c) is an enlarged cross-sectional front view taken along C-C arrows indicated in (c) of FIG. 3.
Figure 5:
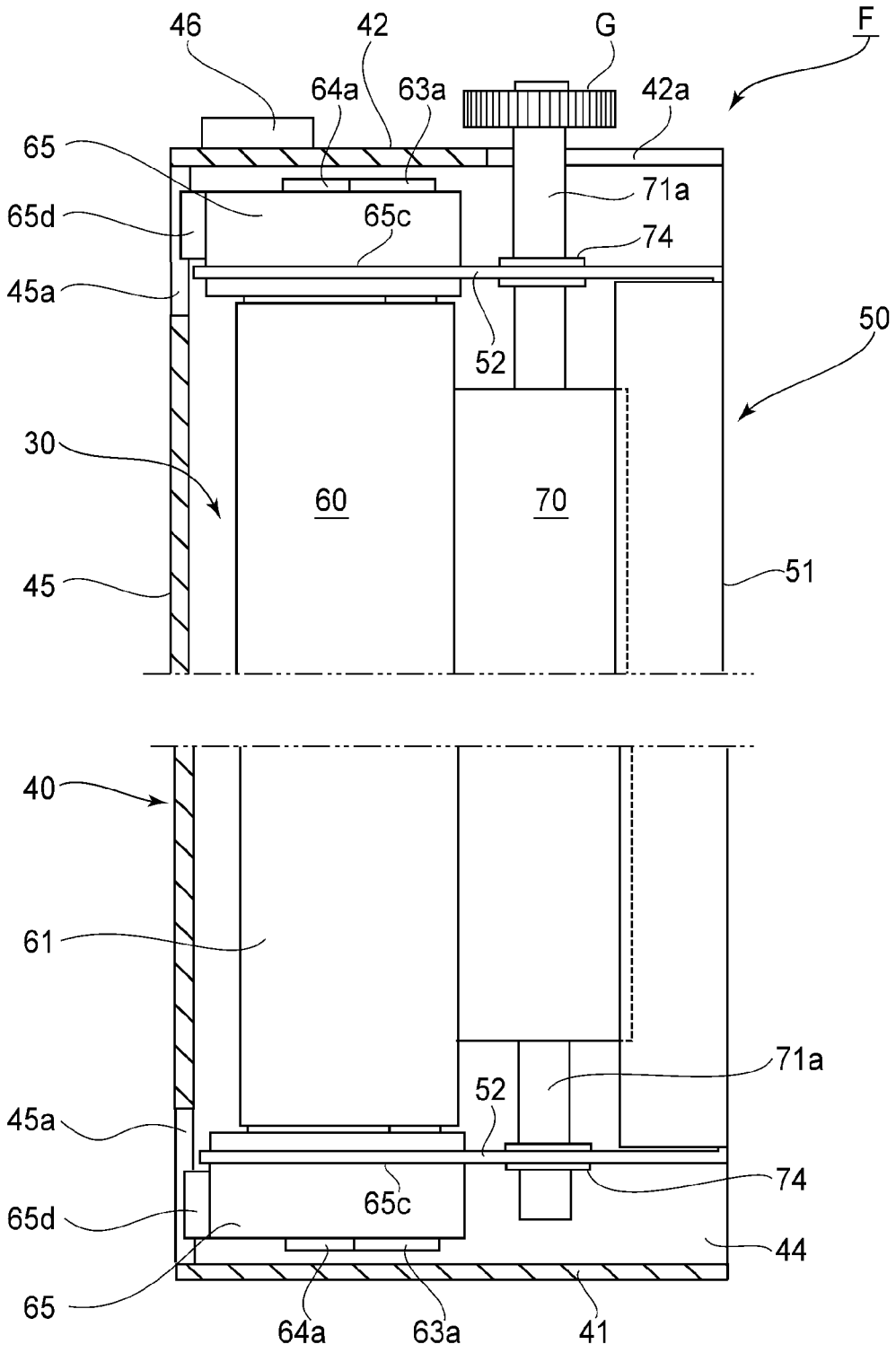
FIG. 5 is a plan view of the fixing device showing an inside thereof by cutting away an upper surface plate of a casing.

In FIG. 3, (a) is a front view of the fixing device F in this embodiment, (b) is a rear view of the fixing device F, (c) is a plan (top) view of the fixing device F from which a halfway portion is omitted, and (d) is a bottom view of the fixing device F from which the halfway portion is omitted. In FIG. 4, (a) is a right side of the fixing device from which a halfway portion is omitted, (b) is a left side view of the fixing device F from which the halfway portion is omitted, and (c) is an enlarged cross-sectional front view taken along C-C arrows indicated in (c) of FIG. 3. FIG. 5 is a plan view of the fixing device F showing an inside thereof by cutting away an upper surface plate of a casing.

The fixing device F in this embodiment is an image heating apparatus of a film (belt) heating type and a pressing roller driving type. This fixing device F is a rectangular parallelopiped device elongated in a front-rear direction, and in the following, with respect to the fixing device F or constituent members thereof, the front side and the rear side are referred to as one end side and the other end side, respectively.

The fixing device F in this embodiment includes a fixing device main body 30 and an outer casing 40 covering 5 surfaces (sides), excluding a right side, consisting of a front side, a rear side, a top side, a bottom side and a left side. The outer casing 40 covers the fixing device main body 30 in a predetermined manner and is fixed on the fixing device main body 30 by a fastening member (not shown) such as a screw. The outer casing 40 includes a front plate 41, a rear plate 42, a top plate 43, a bottom plate 44 and a left plate 45.

At a central portion of the bottom plate 44 of the outer casing 40, a slit-like sheet entrance portion 44*a* and a guiding portion 44*b* are provided along a longitudinal direction. At a central portion of the top plate 43, a slit-like sheet exit portion 43*a* and a guiding portion 43*b* are provided along the longitudinal direction. The rear plate 42 is provided with an electrical contact portion 46. Further, to an outside of the rear plate 42, the other end side shaft portion 71*a* of the pressing roller 70 in the fixing device main body 30 side is projected, and at a projected shaft portion, a drive gear G is fixed.

A hole (portion) 45*a* is provided in each of one end side and the other end side of the left plate 45. This hole 45 is used for permitting coming and going of a pressing block (pressing die) 91 in each of one end side and the other end side of a pressing mechanism 90 (FIG. 12) described later in the apparatus main assembly 1A in a state in which the fixing device F is mounted at a mounting portion 80 of the apparatus main assembly 1A in a predetermined manner. The right surface of the outer casing 40 is open, and at the opening, a right plate 51 of the frame 50 of the fixing device main body 30 is positioned on the same plane.

The fixing device main body 30 includes the frame 50 formed with a metal plate, a film unit 60 which is incorporated into the frame 50 and which includes a fixing film 61 as a fixing member (rotatable member), and a pressing roller 70 as a pressing member (rotatable member). The fixing film 61 is an endless film member or an endless belt member.

The pressing roller 70 is constituted by a core metal 71 of, e.g., iron and a layer 72 of a heat resistant and elastic material such as silicone rubber, a fluorine-containing rubber or a fluorine-containing resin, and is provided with a parting layer 73 as a surface layer. The parting layer 73 can be formed of a material selected from materials, excellent in parting property and heat resistant property, such as the fluorine-containing resin, silicone resin, fluorosilicone resin, the fluorine-containing rubber, the silicone rubber, PFA, PTFE and FEP.

In each of one end side and the other end side of the core metal 71, a small-diameter shaft portion 71*a* is provided concentrically integral with the core metal 71. The small-diameter shaft portion 71*a* of the pressing roller 70 in each of one end side and the other end side is provided by being rotatably held, via a bearing member (pressing portion supporting member) 74, between side plates 52 of the frame 50 in each of one end side and the other end side. The small-diameter portion 71*a* in the other end side is projected outward from the hole 42*a* formed in the rear plate 42 of the outer casing 40, and the drive gear G is fixed at the projected shaft portion. The bearing member 74 is formed of a heat resistant resin such as PEEK, PPS or a liquid crystal polymer in this embodiment.

Figure 6:
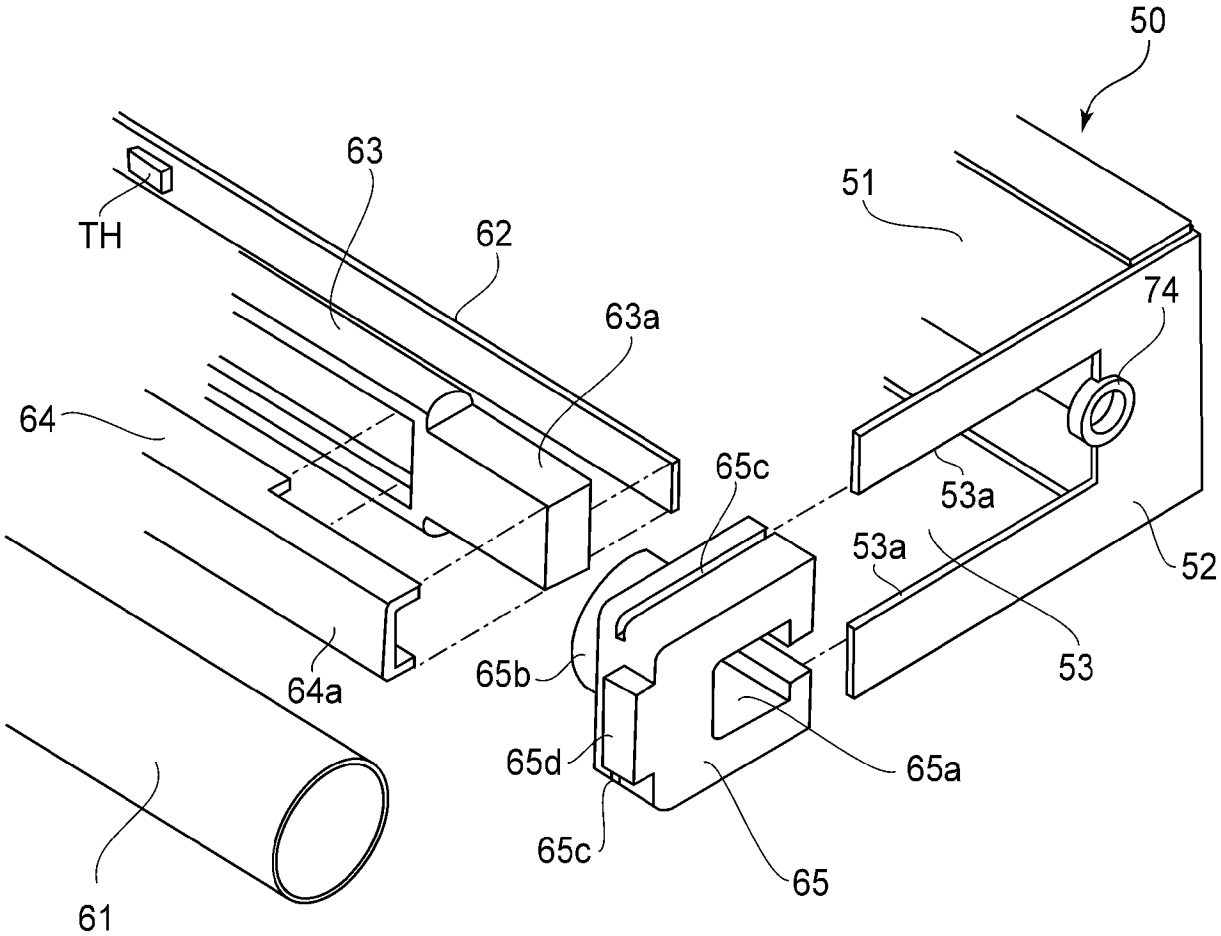
FIG. 6 is an exploded perspective view of constituent materials and a frame of a film unit in one end side.

The film unit 60 is an assembly of a cylindrical and flexible fixing film 61 as a fixing member, a heater 62 as a heating means, a press-contact member (back-up member) 63, a stay 64 and terminal members 65 provided in each of one end side and the other end side. Each of the fixing film 61, the heater 62, the press-contact member 63 and the stay 64 is a long member with respect to a front-rear direction. FIG. 6 is an exploded perspective view of constituent members and the frame 50 of the film unit 60 in one end side. Although those in the other end side are omitted from FIG. 6, they have the same constitutions as those in one end side, and are symmetrical with those in one end side.

The fixing film 61 may preferably be 100 μm or less, more preferably be 50 μm or less and 20 μm or more, in thickness in order to improve a quick-start property by decreasing thermal capacity. It is possible to use a film having a base layer of metal such as SUS or a single-layer film formed of heat resistant material such as PTFE, PFA or FEP. Alternatively, it is also possible to use a composite-layer film obtained by coating FTFE, PFA, FEP or the like on an outer peripheral surface of a base layer of polyimide, polyamideimide, PEEK, PES, PPS or the like. In this embodiment, the fixing film 61 is prepared by forming an elastic layer and a parting layer on a base layer which is formed of a cylindrical thin metal and which has flexibility.

The heater 62 as a heating portion has a basic structure including an elongated thin plate-like ceramic substrate and a heat generating resistor layer, for generating heat by electric power supply, formed on a surface of the substrate, and is a low-thermal capacity ceramic heater increased in temperature with an overall abrupt rising characteristic by electric power supply to the heat generating resistor layer.

The press-contact member 63 is a heat resistant and insulating member having a substantially semicircular trough shape in cross section. As a material for the press-contact member 63, it is possible to use materials, having good insulating and heat resistant properties, such as phenolic resin, polyimide resin, polyamide resin, polyamideimide resin, PEEK resin, PES resin, PPS resin, PFA resin, PTFE resin and LCP resin. The press-contact member 63 has the functions of backing-up the fixing film 61, pressing a nip N (FIGS. 7 and 8) formed by being press-contacted to the pressing roller 70 and improving a feeding stability of the fixing film 61 during rotation. The heater 62 is supported by being engaged in an engaging groove provided along a longitudinal in a fixing film opposing surface side of the press-contact member 63.

The stay 64 is a member formed principally of metal such as iron or SUS, and is used for enhancing longitudinal strength of the press-contact member 63 and rectifying the press-contact member 63 by being pressed against the press-contact member 63 formed of a relative soft resin. The stay 64 is provided superposedly on and disposed in parallel with the press-contact member 63 in an opposite side from the heater 62 side of the press-contact member 63 on which the heater 62 is supported. The fixing film 61 is externally fitted loosely on the superposed member of the press-contact member 63 and the stay 64.

Figure 8:
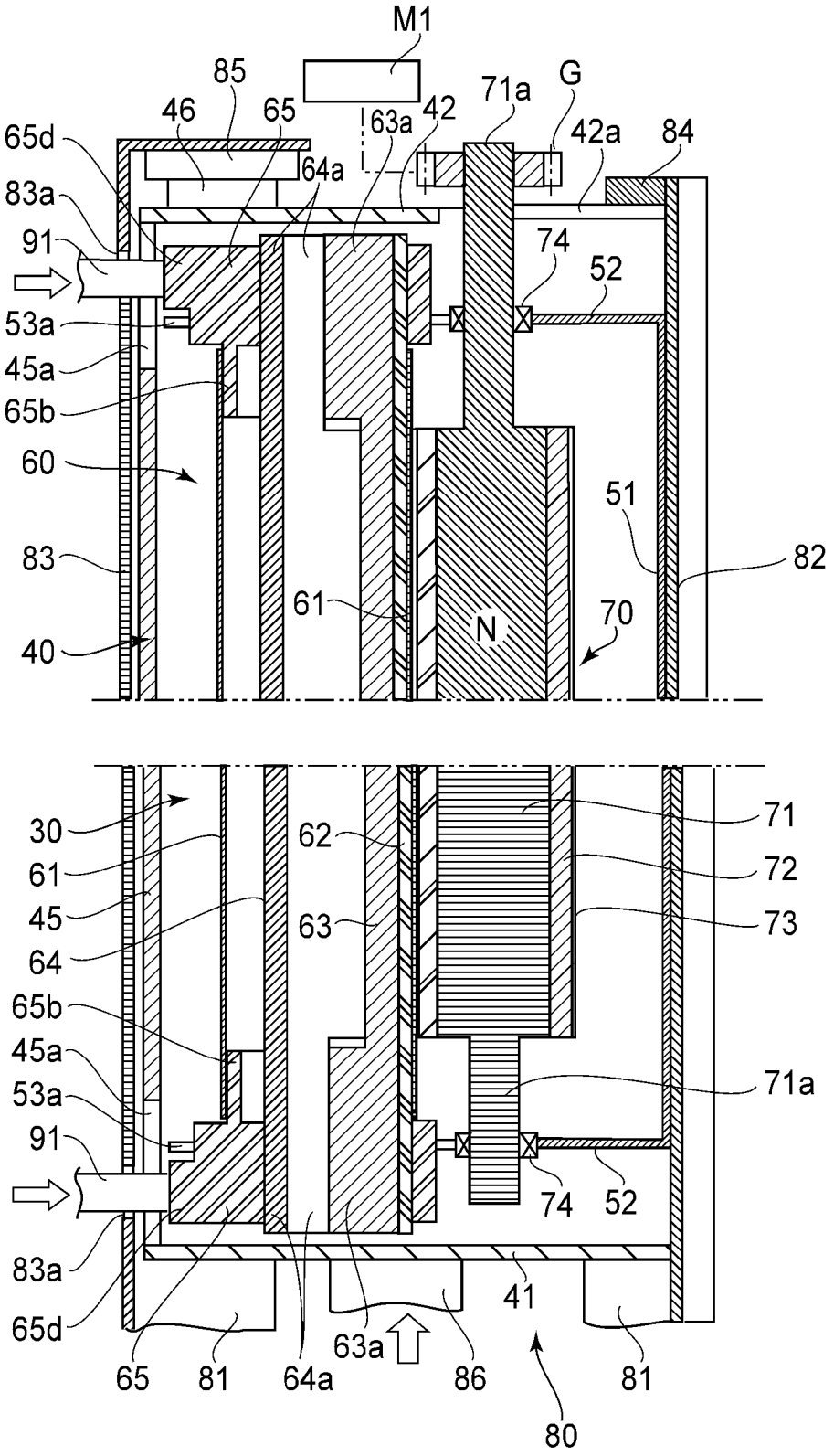
FIG. 8 is a longitudinal sectional view of the fixing device, in the pressed state, from which a halfway portion is omitted.

Each of the terminal members 65 in one end side and the other end side is externally fitted on a press-contact member extension end portion 63*a* and a stay extension end portion 64*a* which are superposedly projected through the opening of the fixing film 61 in each of one end side and the other end side (FIG. 8). As a result, the press-contact member 63 and the stay 64 are kept in a bonded state. Each of the terminal members 65 in one end side and the other end side has the functions of not only limiting movement of the fixing film 61, in the longitudinal direction during rotation, externally fitted loosely on the press-contact member 63 and the stay 64 but also limiting (regulating) a shape of the fixing film end portion (a fixing film locus) with respect to a circumferential direction.

Each of the terminal members 65 in one end side and the other end side is a molded member using a heat resistant resin such as PPS or LCP, and the terminal members provide a symmetrical shape and have the same structure. Each terminal member 65 is provided with a hole (portion) 65*a* into which the superposed extension end portions 63*a* and 63*b* of the press-contact member 63 and the stay 54 are inserted to be held. Further, in an inner surface side, a guiding member (fixing film locus regulating member) 65*b* for guiding an inner peripheral surface of the end portion of the fixing film 61 is provided. The guiding member 65*b* is a substantially semicircular projected edge member having an outer diameter substantially corresponding to an inner diameter of the cylindrical fixing film 61.

Figure 7:
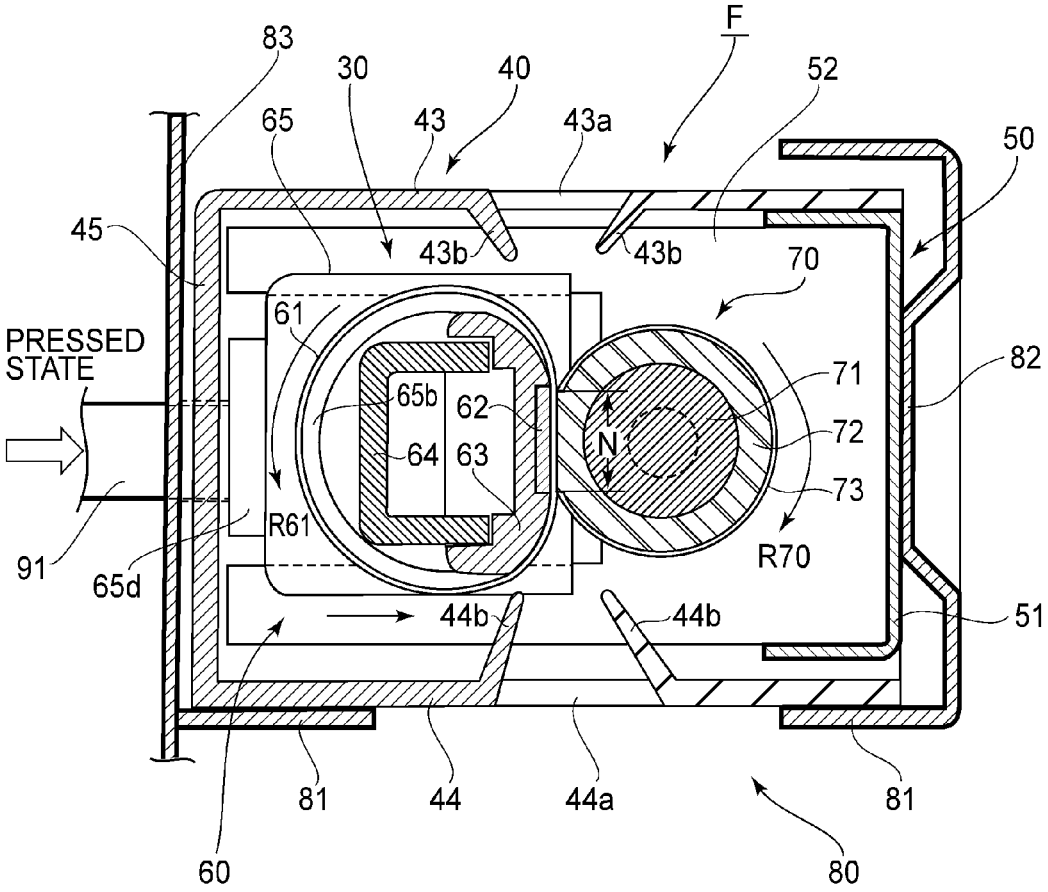
FIG. 7 is an enlarged cross-sectional front view of the fixing device which is mounted at a mounting portion in an apparatus main assembly in a predetermined manner and which is in a pressed state.

In a state in which each of the terminal members 65 in one end side and the other end side is mounted in a predetermined manner on the superposed extension end portions 63*a* and 64*a* of the press-contact member 63 and the stay 64, the guiding member 65*b* is engaged inside the end portion of the fixing film 61 (FIGS. 7 and 8). Further, each terminal member 65 is provided with a guiding groove 65*c* in parallel to a left-right direction in each of an upper surface side and a lower surface side. Further, in a left side, a pressure-receiving projected portion 65*d* is provided.

The film unit 60 having the above structure is disposed in parallel with the pressing roller 70 in the left side of the pressing roller 70 between the side plate 53 in each of one end side and the other end side of the frame 50 in a state in which the heater 62 opposes the pressing roller 70.

Specifically, in the film unit 60, the upper and lower guiding grooves 64*c*, extending in the left-right direction, of the terminal members 65 in one end side and the other end side are engaged with the guiding edge portions 53*a*, extending in the left-right direction, of the guiding slit portion 53, extending in the left-right direction, of the side plates 52 of the frame 50 in one end side and the other end side, respectively. As a result, the film unit 60 is supported movably, by sliding engagement between the guiding groove 65*c* and the guiding edge portion 52*a* between the side plates 51 of the frame 50 in one end side and the other end side, in the right direction in which the film unit 60 is shifted toward the pressing roller 70 side and the left direction in which the film unit 60 is spaced from the pressing roller 70.

In the fixing device F described above, the fixing film 61 and the pressing roller 70 are members having a high possibility that the members of members for the fixing portion are required to be replaced in a period of an operation of the image forming apparatus.

(2-2) Fixing Operation

The fixing device F is mounted and used in a state in which the fixing device F is capable of being inserted into and pulled out from the mounting portion 80 of the apparatus main assembly 1A. In the apparatus main assembly 1A side, the pressing mechanism 90 (FIGS. 1 and 13) for forming the nip N by pressing the pressing roller 70 as the pressing member and the fixing film 61 as the fixing member of the fixing device F mounted in the mounting portion 80 is provided. Further, a pressure-releasing (eliminating) mechanism 120 (moving mechanism or retracting mechanism) for switching the pressure at the nip N between a pressed state and a pressure-released (eliminated) state by operating the pressing mechanism 90 is provided. Details of the pressing mechanism 90 and the pressure-releasing mechanism 120 will be described later.

FIG. 7 is an enlarged cross-sectional front view of the fixing device F in a state in which the fixing device F is mounted in the mounting portion 80 inside the apparatus main assembly 1A in a predetermined manner and in which the film unit 60 is pressed against the pressing roller 70 in a predetermined manner by the pressing operation of the pressing mechanism 90. FIG. 8 is a longitudinal sectional plan view of the fixing device F, in the pressed state, from which a halfway portion is omitted.

In the state in which the fixing device F is mounted in the mounting portion 80 in the predetermined manner, the bottom plate 44 of the outer casing 40 is supported by a lower frame 81 of the mounting portion 80. The right side plate 51 of the frame 50 of the fixing device main body 30 is regulated by the lower frame 81 of the mounting portion 80. The left side plate 45 of the outer casing 40 is regulated by a left frame 83 of the mounting portion 83. The rear plate 42 of the outer casing 40 is received by a rear stopper portion 84 of the mounting portion 80. Each of the lower frame 81, the right frame 82 and the left frame 83 of the mounting portion 80 is a long member with respect to the front-rear direction and functions as also a guiding member during insertion and pulling-out of the fixing device F.

Further, the front plate 41 of the outer casing 40 is pressed by an urging member 86, so that the fixing device F is urged from one end side toward the other end side. As a result, the rear plate 42 of the outer casing 40 is pressed against the rear stopper portion 84 of the mounting portion 80, so that the fixing device F is positioned in the mounting portion with respect to the front-rear direction. The drive gear G provided in the other end side of the fixing device F is connected with a drive output portion (not shown) in the apparatus main assembly 1 side. The electrical contact portion 46 provided in the other end side of the fixing device F is connected with an electrical contact portion 85 in the apparatus main assembly 1 side.

Figure 12:
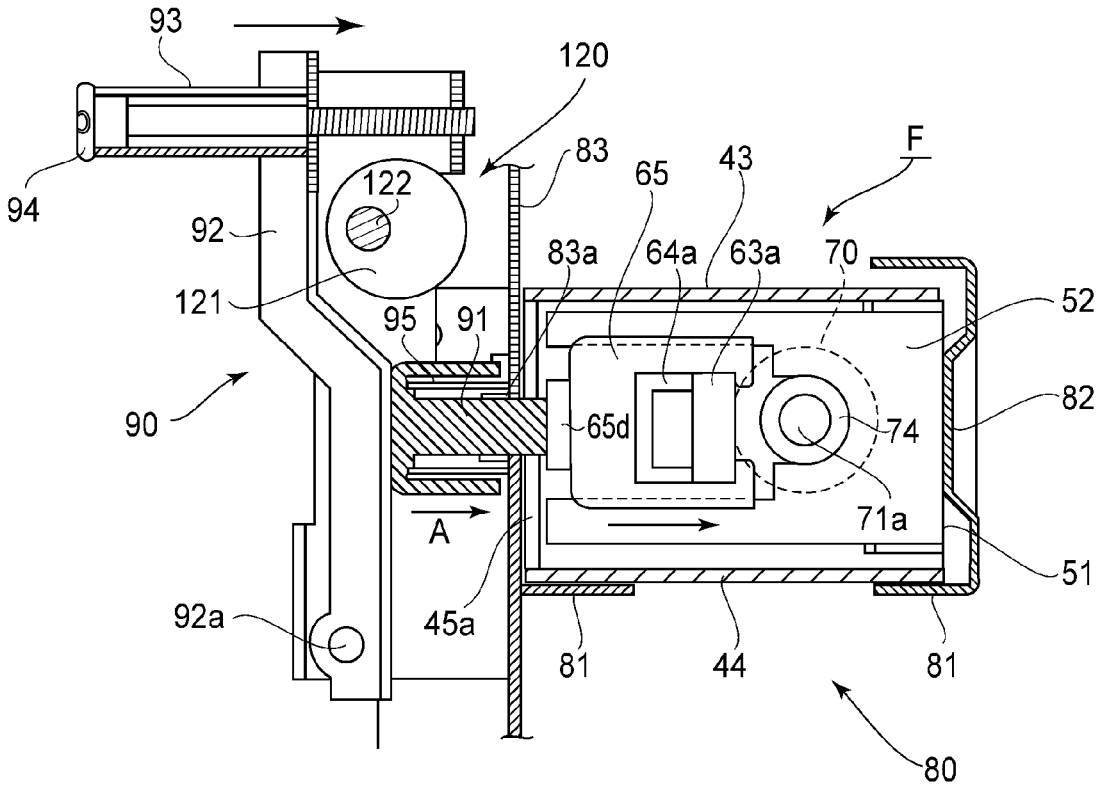
FIG. 12 is a schematic view showing a pressing mechanism and a pressure-releasing mechanism in the pressed state.
Figure 13:
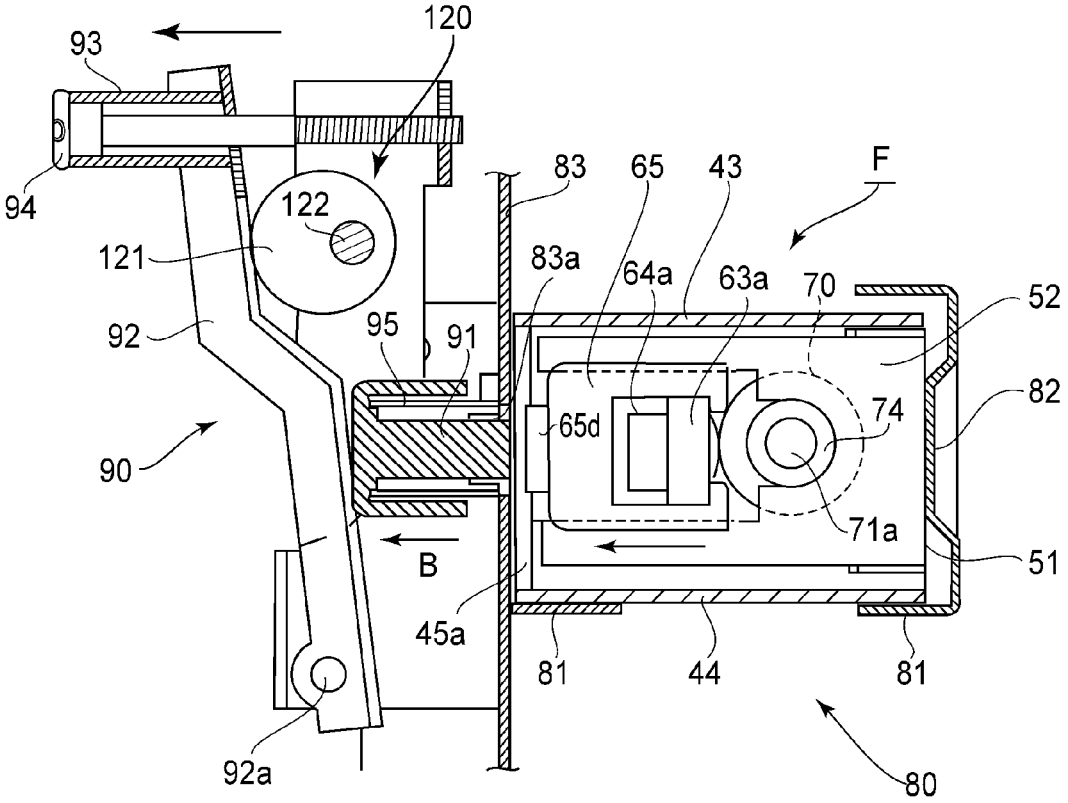
FIG. 13 is a schematic view showing the pressing mechanism and the pressure-releasing mechanism in a pressure-released state.

Further, in an opposite side from the fixing device F side of the left frame 83 of the mounting portion 80, the pressing mechanism 90 and the pressure-releasing mechanism 120 are provided (FIGS. 12 and 13). Further, a constitution in which the pressing block 91 of the pressing mechanism 90 in each of one end side and the other end side comes out of and enters the fixing device F through the hole 83*a* of the left frame 83 in the associated one of one end side and the other end side.

During execution of image formation of the image forming apparatus 1, the fixing device F is placed in the pressed state by the pressing mechanism 90. That is, in the pressed state of the fixing device F, the pressing block 91 of the pressing mechanism 90 in each of one end side and the other end side projects from the hole 83*a* of the left frame 83 in the associated side toward the fixing device F and then enters the inside of the fixing device main body 30 through a hole 45*a* of the outer casing 40 of the fixing device F in the associated side. As a result, the pressure-receiving projected portion 65*d* of the terminal member 65 of the fixing device main body in each of one end side and the other end side is pressed by the associated pressing block 91. For that reason, each of the terminal members 65 in one end side and the other end side is slid and moved rightward by slip engagement between the guiding groove 65*c* and the guiding edge portion 52*a*.

As a result, the fixing film 61 is press-contacted, via the stay 64, the press-contact member 63 and the heater 62 in the film unit 60, to the left side surface of the pressing roller 70 against elasticity of the elastic layer 72 by a predetermined pressing force. By this press-contact, the nip (fixing nip) N having a predetermined width is formed between the fixing film 61 and the pressing roller 70 with respect to a sheet feeding direction.

In the pressed state of this fixing device F, the right plate 51 of the frame 50 of the fixing device main body 30 is pressed against the right fixing device 82 of the mounting portion 80 by the pressing force of the pressing block 91 and a compression reaction force of the elastic layer 72 of the pressing roller 70, thus being regulated or limited. As a result, the fixing device F is positioned in the mounting portion 80 with respect to the left-right direction.

In the pressed state of the fixing device F, the control circuit portion 100 starts electric power supply from a power source portion 102 (FIG. 9) to the heater 62 at control timing. Further, a driving portion M1 is actuated to transmit a driving force to the drive gear G via the drive output portion. As a result, the pressing roller 70 is rotated in the clockwise direction indicated by an arrow R70 in FIG. 7.

By a frictional force generated by the rotational drive of the pressing roller 70 at the nip N between the pressing roller 70 and the outer surface of the fixing film 61, a rotational force (rotation torque) acts on the fixing film 61. Then, the fixing film 61 is rotated in the counterclockwise direction indicated by an arrow R61 in FIG. 7 at a peripheral speed substantially corresponding to the rotational peripheral speed of the pressing roller 70 while being hermetically contacted to and slid on the surface of the heater 62 at the nip N at the inner surface of the fixing film 61.

The press-contact member 63 has the functions of not only holding the heater 62 but also being used as the guiding member for improving feeding stability of the rotating fixing film 61. Each of the terminal members 65 in one end side and the other end side limits lateral movement (shift) of the fixing film 61 by receiving the fixing film end portion in the laterally moved side when the rotating fixing film 61 is laterally moved in the associated side (one end side or the other end side) along the longitudinal direction of the press-contact member 63. Further, the guiding member 65*b* guides the inner peripheral surface of the fixing film 61 in each of the end sides so that a circumferential shape of each of the end portions when the fixing film 61 is rotated is limited (regulated).

The electric power supply from the power source portion 102 to the heater 62 is made via the electrical contact portion 85 in the apparatus main assembly 1 side and the electrical contact portion 46 in the fixing device side. Incidentally, electrical conduction circuit constitution between the electrical contact portion 46 and the heater 62 was omitted from the figures. The heater 62 is abruptly increased in temperature by the electric power supply. Then, the temperature of the heater 62 is detected by the temperature sensor TH (FIG. 6) such as a thermistor as a temperature detecting means provided in a rear surface side of the heater 62.

Then, electrical information as to a detection temperature of the temperature sensor TH is fed back to the control circuit portion 100 via the fixing device-side electrical contact portion 46 and the apparatus main assembly 1A-side electrical contact portion 85. The control circuit portion 100 controls the electric power supplied from the power source portion 102 to the heater 62 so that the electrical information as to the detection temperature inputted from the temperature sensor TH is kept at a value substantially corresponding to a predetermined fixing temperature. Incidentally, electrical conduction circuit constitution between the electrical contact portion 46 and the temperature tension TH was omitted from the figures.

In this way, in a state in which the pressing 70 is rotated and the fixing film 61 is rotated by the drive of the pressing roller 70 and in which the temperature of the heater 62 is controlled at the predetermined fixing temperature, the sheet P on which the toner image is transferred is introduced into the fixing device F from the sheet entrance portion 44*a* of the fixing device F in the bottom side. Then, the sheet P enters the nip N and is nipped and fed upward. As a result, the toner image and the sheet P are heated and pressed, so that the toner image is fixed as a fixed image on the sheet P. The sheet P coming out of the nip N is sent from the upper-side sheet exit portion 43*a* of the fixing device F to the outside of the fixing device F.

When an image forming job of a predetermined one sheet or a plurality of continuous sheets is ended, the control circuit portion 100 stops the electric power supply to the heater 62. Further, the control circuit portion 100 stops the drive of the driving portion M1. The control circuit portion 100 operates the pressure-releasing mechanism 120 to release (eliminate) the pressed state of the fixing device F by the pressing mechanism 90. The control circuit portion 100 holds the image forming apparatus 1 in a stand-by state until a subsequent image forming job start signal is inputted while keeping the fixing device F in the pressure-released state.

Figure 10:
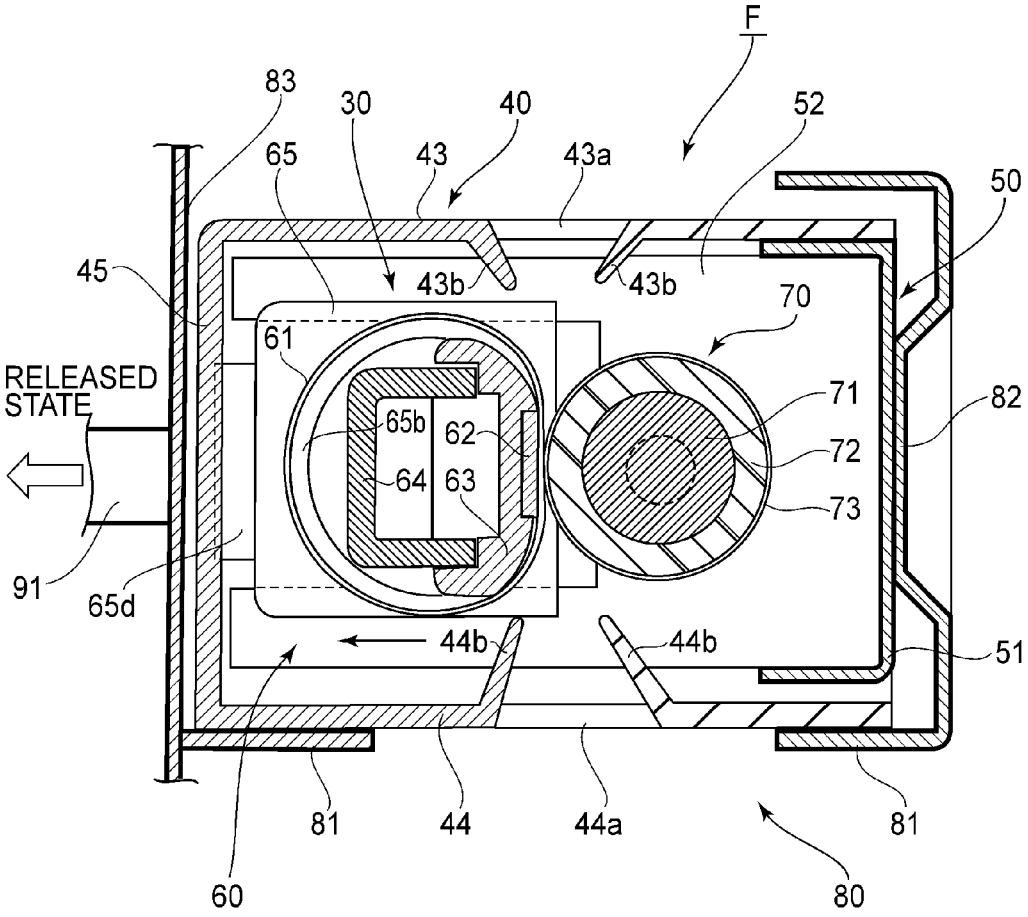
FIG. 10 is an enlarged cross-sectional front view of the fixing device which is mounted at a mounting portion in the apparatus main assembly in a predetermined manner and which is in a pressed state.
Figure 11:
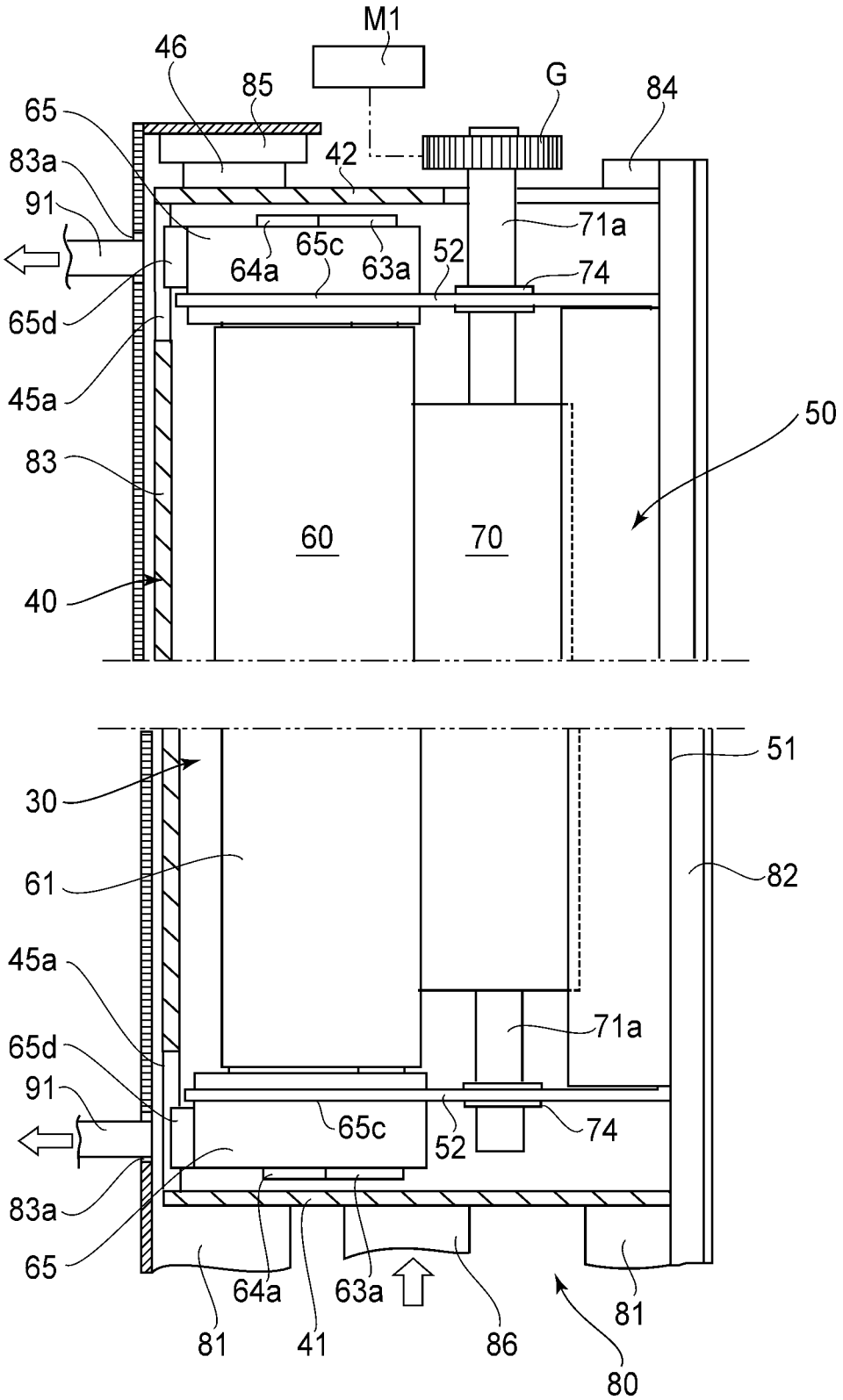
FIG. 11 is a longitudinal sectional view of the fixing device, in pressure-released (eliminated) state, from which a halfway portion is omitted.

In the pressure-released state of the fixing device F, each of the pressing blocks 91 in one end side and the other end side is, as shown in FIGS. 10 and 11, moved to the outside from the hole portion 45*a* of the fixing device F in the associated side. Then, the pressing block 91 is maintained in a state in which an end portion thereof is positioned inside the hole portion 86 of the left frame 83 of the mounting portion 80 in the associated side.

(2-3) Mounting and Demounting Type of Fixing Device

In this embodiment, mounting and demounting and replacement of the fixing device F relative to the apparatus main assembly 1A are of a type in which these operations are performed from the front side of the image forming apparatus 1 by front access in order to improve usability. That is, the front plate 21 of the apparatus main assembly 1A is provided with the opening 22 (FIG. 1) for permitting passing of the fixing device F for the purpose of inserting the fixing device F into the mounting portion 80 of the apparatus main assembly 1A and demounting the fixing device F from the mounting portion 80.

In FIG. 1, X and Y represent an inserting (movement) direction and a demounting (movement) direction, respectively, of the fixing device F relative to the mounting portion 80. At the opening 22, a door (front door) 23 as an openable member capable of moving to a closing position of the opening 22 and an open position of the opening 22 is provided.

In this embodiment, this door (cover) 23 is rotatable about a hinge portion (not shown) provided in the lower side thereof so as to be opened and closed relative to the front plate 21. That is, the door 23 is rotationally moved about the hinge portion in a raising direction, thus being capable of being placed in a closed state with respect to the front plate 21. By the closing operation of this door 23, the opening 22 is closed (covered). Further, the door 23 can be rotationally moved about the hinge portion in a falling direction toward the front side. As a result, the opening 22 is opened (exposed). The opening and closing operation of the door 23 is manually performed. Alternatively, the opening and closing operation of the door 23 can also be automatically performed by a key operation of an operator at the operating portion 101 for the purpose of providing instructions to perform various operations.

The demounting of the fixing device F mounted in the mounting portion 80 inside the apparatus main assembly 1A is performed in the following manner. The demounting of the fixing device F can be performed during stand-by in which the image forming apparatus 1 does not perform the image forming operation and during a rest period of the image forming apparatus 1. During the stand-by and during the rest period, the pressure of the fixing device F by the pressing mechanism 90 is released.

Accordingly, each of the pressing blocks 91 in one end side and the other end side is moved to the outside of the fixing device F through the hole portion 45*a* in the associated side as shown in FIGS. 10 and 11. Further, the pressing block 91 is kept in the state in which the end portion thereof is positioned inside the hole portion 83*a* of the left frame 83 of the mounting portion 80 in the associated side (one end side or the other end side).

The user (operator) opens the door 23 manually or automatically, so that the opening 22 is placed in the open state. By opening the door 23, the urging member 86 pressing the front plate 41 of the outer casing 40 of the fixing device F is retracted from a region of the front plate 41 to the outside of the region, so that the pressing is released (eliminated). That is, these devices perform the function as an interrelating mechanism. The fixing device F mounted in the mounting portion 80 faces the exposed opening 22 in one end side thereof.

Therefore, the user grips one end side of the fixing device F at the opening 22 and then slides and moves the fixing device 80 toward the front side along the long frames 81, 82 and 83, as the guiding members, with respect to the front-rear direction in the lower side, the right side and the left side of the mounting portion 80. By this movement of the fixing device F in the pulling-out direction, the drive gear G and the electrical contact portion 46 in the other end side of the fixing device F are separated and disconnected from the drive output portion and the electrical contact portion 85, respectively, in the apparatus main assembly 1A side. Then, the fixing device F is further pulled out and moved from the mounting portion 80, thus being pulled out to the outside of the apparatus main assembly 1A. As a result, the fixing device F is demounted from the mounting portion 80 of the apparatus main assembly 1A by the front access.

During the pulling-out movement of the fixing device F, the pressing mechanism 90 in the apparatus main assembly 1A side is kept in the pressure-released state. That is, each of the pressing blocks 91 in one end side and the other end side is, as shown in FIGS. 10 and 11, moved to the outside of the fixing device F through the hole portion 45*a* in the associated side. Further, the pressing block 91 is kept in the state in which the end portion thereof is positioned inside the hole portion 83*a* of the left frame 83 of the mounting portion 80 in the associated side. That is, the pressing block 91 is retracted to the outside from a region projected along the X-Y direction which is the mounting and demounting direction of the fixing device F relative to the mounting portion 80.

Accordingly, without obstructing the pulling-out movement of the fixing device F by the pressing block 91, the fixing device F is capable of being demounted from the mounting portion 80 by being pulled-out and moved to the outside of the apparatus main assembly 1A along the frames 81, 82 and 83 as the guiding members.

That is, the pressing mechanism 90 presses the fixing film 61 toward the pressing roller 70 by entering a space (also called a mounting and demounting locus), through which the fixing device F passes in the mounting portion 80 during the mounting and demounting of the fixing device F, along a direction substantially perpendicular to the longitudinal direction (mounting and demounting direction perpendicular to the drawing sheet of FIG. 12) of the fixing device F. Accordingly, when the fixing device F is mounted and demounted, at least a constitution in which the pressing mechanism 90 is retracted from this space is employed. Incidentally, this space refers to a three-dimensional space formed when a rectangular cross-section of the fixing device F is translated in the direction (mounting and demounting direction of the fixing device F) perpendicular to the drawing sheet of FIG. 12 (FIG. 13).

Alternatively, the pressing mechanism 90 presses between the fixing film 61 and the pressing roller 70 by entering an overlapping region with the fixing device F when the fixing device F mounted in the mounting portion 80 is viewed substantially along the longitudinal direction (mounting and demounting direction). Accordingly, when the fixing device F is mounted and demounted, at least the pressing mechanism 90 is retracted from this overlapping region.

As a result, when the fixing device F is inserted and pulled out (when the fixing device F is linearly slid and moved), the fixing device F does not interfere with the member 90.

On the other hand, the mounting of the fixing device F is performed in the following manner. That is, the fixing device F is inserted though the exposed opening 22 from the other end side with the upper surface directed upward. Then, the fixing device F is pushed into the mounting portion 80 by being slid and moved toward the rear side of the mounting portion 80 along the long frames 81, 82 and 83, as the guiding members, with respect to the front-rear direction, in the lower side3, the right side and the left side of the mounting portion 80. By sufficiently pushing the fixing device F into the mounting portion 80, the outer surface of the rear plate 42 of the outer casing 40 of the fixing device F abuts against the stopper member 84 in the apparatus main assembly 1A side. As a result, further pushing in movement of the fixing device F is prevented.

In this state, the drive gear G of the fixing device F in the other end side is connected with the drive output portion of the apparatus main assembly 1A. Further, the electrical contact portion 46 of the fixing device F in the other end side is connected with the electrical contact portion 85 of the apparatus main assembly 1A.

During the pushing-in movement of the fixing device F, similarly as during the pulling-out movement of the fixing device F, the pressing mechanism 90 in the apparatus main assembly 1A side is kept in the pressure-released state. That is, each of the pressing blocks 91 in one end side and the other end side is, as shown in FIGS. 10 and 11, moved to the outside of the fixing device F through the hole portion 45*a* in the associated side. Then, the pressing block 91 is kept in the state in which the end portion thereof is positioned inside the hole portion 86 of the left frame 83 of the mounting portion 80 in the associated side.

That is, the pressing block 91 is retracted from the region projected along the X-Y direction which is the mounting and demounting direction of the fixing device F relative to the mounting portion 80.

Accordingly, without obstructing the pushing-in movement of the fixing device F by the pressing mechanism 90, it is possible to push the fixing device F into the inside of the apparatus main assembly 1A along the longitudinal direction of the frames 81, 82 and 83, as the guiding members, of the mounting portion 80. When the fixing device F is sufficiently pushed in, the door 23 is manually or automatically closed to cover the opening 22. By closing the door 23, the urging member 86 for urging the front plate 41 of the outer casing 40 of the fixing device F is returned and moved to the original position to urge the front plate 41, so that the fixing device F is urged from one end side toward the other end side. As a result, the fixing device F is positioned in the mounting portion 80 with respect to the front-rear direction.

As described above, the fixing device F is mounted in the mounting portion 80 of the apparatus main assembly 1A by the front access.

(3) Pressing Mechanism and Pressure-Releasing Mechanism

In the constitution in which the fixing device F is replaced from the apparatus main assembly 1A in the above-described manner, when the pressing mechanism 90 for the fixing device F is placed in the apparatus main assembly 1A, it would be assumed that the replacement of the fixing device F is obstructed. In this regard, the pressing mechanism 90 for pressing the fixing device F and the pressure-releasing mechanism 120 for releasing the pressure applied to the fixing device F in this embodiment will be described.

The fixing device F fixes the toner image under application of heat and pressure as described above, and is required to be provided with the pressing mechanism for applying pressure to the fixing member 61 and the pressing member 70 for the purpose of forming the fixing nip N. In this embodiment, a constitution in which the number of replacement members for the fixing device F is minimized and in which other members are disposed in the apparatus main assembly 1A is employed, and also the pressing mechanism 90 for the fixing portion is disposed in the apparatus main assembly 1A.

The pressing mechanism 90 for pressing the fixing member 61 and the pressing member 70 and the pressure-releasing mechanism 120 for releasing the pressure applied to the fixing member 61 and the pressing member 70 will be described with reference to FIGS. 12 and 13. FIGS. 12 and 13 show the pressing mechanism 90 and the pressure-releasing mechanism 120 with respect to the terminal member 65 of the fixing device F in one end side. Although those with respect to the terminal member 65 of the fixing device F in the other end side are omitted from FIGS. 12 and 13, these mechanisms have the same constitutions as the mechanisms 90 and 120 with respect to the terminal member 65 in one end side.

The pressing mechanism 90 in this embodiment is disposed in an opposite side from the fixing device F with respect to the left frame 83 of the mounting portion 80 in the apparatus main assembly 1A. The pressing mechanism 90 includes the belt 91 for generating the pressing force (pressure) by being pressed against each of the terminal members 65 of the fixing device F in one end side and the other end side, a pressing plate 92 for pressing the pressing block 91, and a pressing elastic member 93 for generating the pressing force in contact with the pressing plate 92. Further, the pressing mechanism 90 includes a pressing elastic member mounting member 94 for supporting the pressing elastic member 93 and is also used for adjusting the pressing elastic member 93 so as to generate a desired pressing force.

The pressing 91 is supported at a right end portion thereof by the left frame 83 of the mounting portion 80 *s* as to be movable to a first position A where the right end portion projects through the hole portion 83*a* provided in the left frame 83 toward the fixing device F side as shown in FIG. 12 and a second position B retracted into the hole portion 83*a* as shown in FIG. 13. The pressing block 91 is urged in a direction of being moved to the second position B by an elastic member (coil spring) 95 compressedly provided between the pressing block 91 and the left frame 83.

FIG. 12 shows a state in which the fixing device F is pressed by the pressing mechanism 90. The pressing plate 92 is a lever rotatable about a supporting shaft portion 92*a*, and in a free state, the pressing plate 92 presses a left-side head portion of the pressing block 91 by being rotated about the supporting shaft portion 92*a* in the clockwise direction in FIG. 12 by the pressing force of the pressing elastic member 93. The pressing force is set at a value larger than the urging force of the elastic member 95 by a predetermined value. For that reason, the pressing block 91 is moved to the first position A against the urging force of the elastic member 95.

As a result, each of the pressing block as 91 in one end side and the other end side projects through the hole portion 83*a* of the left frame 83 in the associated side toward the fixing device F side and then enters the inside of the fixing device main body 30 through the hole portion 45*a* of the outer casing 40 of the fixing device F in the associated side. Then, the pressure-receiving projected portion 65*d* of each of the terminal members 65 of the fixing device main body 30 in one end side and the other end side is pressed by the pressing block 91, so that the terminal member 65 in the associated side slides and moves rightward by slip engagement between the guiding groove 65*c* and the guiding edge portion 52*a*.

Accordingly, as described with reference to FIGS. 7 and 8, the fixing device F is placed in the pressed state, so that the nip N having a predetermined width with respect to the sheet feeding direction is formed between the fixing film 61 and the pressing roller 70.

Figure 9:
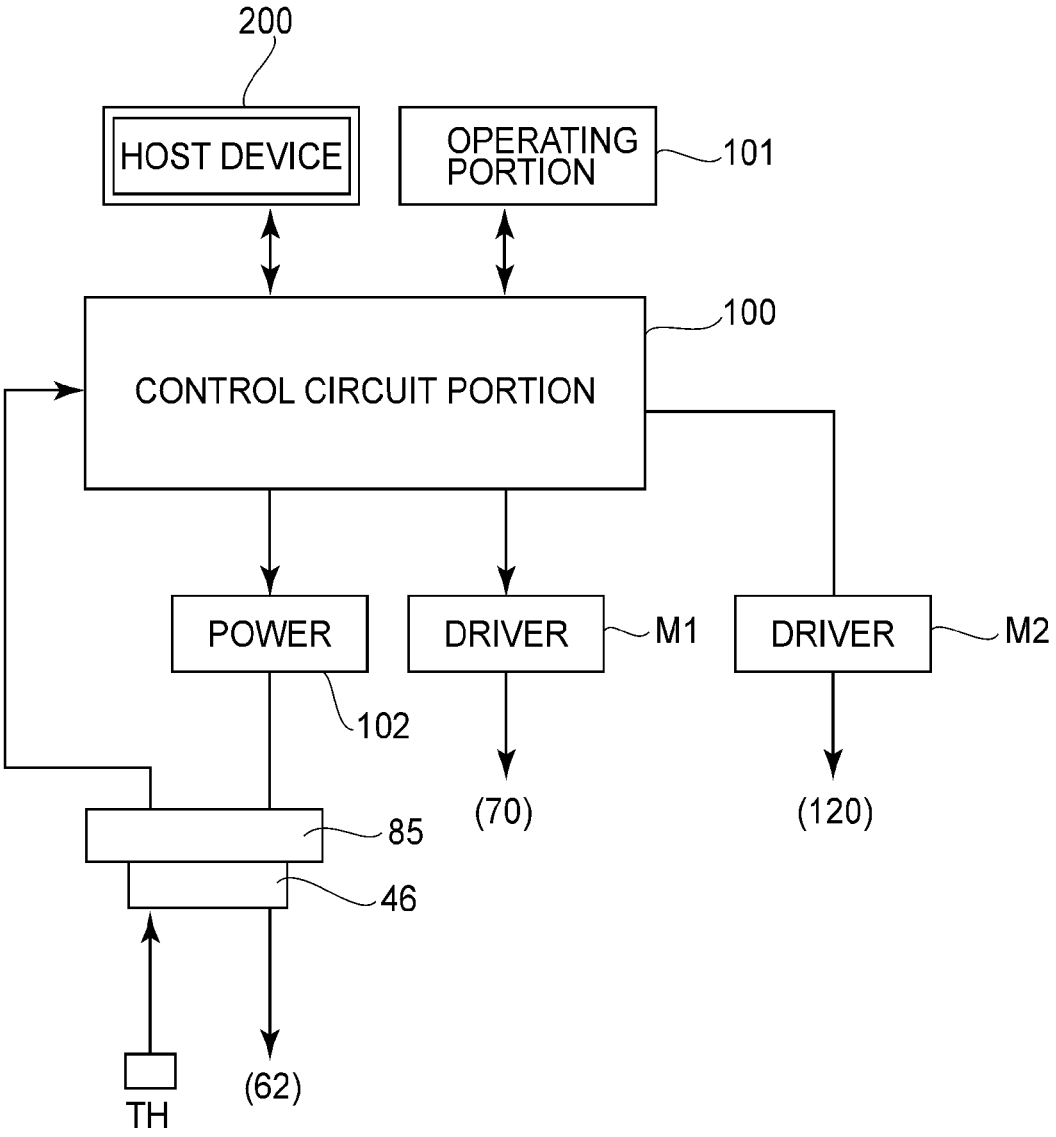
FIG. 9 is a block diagram of a control system.

Next, the pressure-releasing mechanism 120 for switching the state of the pressing mechanism 90 between the pressed state and the pressure-released state will be described. The pressure-releasing mechanism 120 includes a pressing cam 121 for lowering the pressing force exerted on the pressing block 91 by moving the above-described pressing plate 92 in a direction of being retracted from the pressing block 91 against the pressing force of the pressing elastic member 93, and includes a pressing shaft 122 for supporting the pressing cam 121. Further, the pressure-releasing mechanism 10 includes a pressing can driving gear (not shown), connected with the pressing shaft 122, for rotating the surface shaft 122 by being rotated by a driving source M2 (FIG. 9).

The pressing cam 121 is rotated about the pressing shaft 122, so that the pressing plate 92 is swung and rotated about the shaft 92*a* in the clockwise direction and the counterclockwise direction in FIG. 13. By the rotation of the pressing plate 92 in the clockwise direction, the head portion of the pressing block 91 is pressed and moved to the first position A in FIG. 12 where the fixing device F is placed in the pressed state. Further, by the rotation of the pressing plate 92 in the counterclockwise direction, the pressing plate 92 is retracted and moved from the head portion of the pressing block 91. With this movement, the pressing block 91 is moved from the first position A in FIG. 12 to the second position B in FIG. 13 by the urging force of the elastic member 95.

The control circuit portion 100 controls the driving portion M2 for the pressure-releasing mechanism 120 so that the fixing device F is in the pressed state of FIG. 12 during execution of the image formation and is in the pressure-released state of FIG. 13 during a period other than during the execution of the image formation, so that the state of the pressing mechanism 90 is switched between the pressed state and the pressure-released state.

During the pressing of the fixing device F, the pressing block 91 of the pressing mechanism 90 is pressed by a pressing force further larger than the urging force of the elastic member 95 by the pressure of the pressing elastic member 92 exerted on the pressing plate 92 and is positioned at the first position A, thus being pressed against the terminal member 65 of the fixing device F. As a result, the fixing device F is placed in the pressed state.

During the pressure-released state of the fixing device F, by the movement of the pressing plate 92 in the retracting direction, the pressing block 91 of the pressing mechanism 90 is moved from the first position A to the second position B by the urging force of the elastic member 95. By the movement of the belt 91 to the second position B, the end portion of the pressing block 91 is moved to the outside of the fixing device F through the hole portion 45*a* and then is positioned inside the hole portion 83*a* of the left frame 83 of the mounting portion 80. That is, the belt 91 is retracted to the outside a projected region as seen from the X-Y direction as the insertion and pulling-out direction of the fixing device F relative to the mounting portion 80.

As a result, a force exerted on the fixing device F from the apparatus main assembly 1A side is eliminated, and thus when the fixing device F is intended to be pulled out to the front side of the apparatus main assembly 1A or when the fixing device F is intended to be inserted for mounting, the fixing device F is in a state in which there is no obstacle to the pulling-out and insertion of the fixing device F.

In addition, in the pressed state, the pressing block 91 is directly contacted to the terminal member 65 supporting the fixing film 61 heated to a very high temperature of, e.g., 150° C. for fixing, and therefore the pressing block 91 may desirably be formed of a resin material having a high heat resistant property.

In this way, the pressing block 91 is formed of the resin material having a relatively low thermal conductivity, so that it is possible to realize a no-problem state even in the case where if the operator touches the pressing block 91 in the pulled-out state of the fixing device F.

As described above, by placing the fixing device F in the pressure-released state, in a state in which the pressing mechanism 90 is left in the apparatus main assembly 1A, it becomes possible to pull out the fixing device F along the longitudinal direction thereof. As a result, it is possible to realize the image forming apparatus capable of easily replacing, by the operator, only a necessary minimum member of the members constituting the fixing portion.

Other Embodiments

The embodiments according to the present invention was described above, but the constitutions therein can also be replaced with other known various constitutions within the scope of a concept in the present invention.

1) The fixing device F is not limited to the apparatus for heat-fixing the (unfixed) toner image, as the fixed image, carried on the sheet by heating and pressing the toner image as in the embodiment. The fixing device F also includes an apparatus (device) for adjusting a surface property of an image such that a glossiness of the image (fixed image or partly fixed image) once or temporarily fixed on the sheet.

2) It is also possible to use the fixing device in which the heating member is a roller to be rotationally driven. It is also possible to use the fixing device in which the heating member is an endless film or belt member to be rotationally driven. In the case where the heating member is directly driven by a driving means, the pressing member may also be not required to be the rotatable member, but can be a non-rotatable member such as a pad or a plate-like member having a low friction coefficient at a surface which is a contact surface with the heating member or the recording material.

3) The heating portion for heating the heating member is not limited to the ceramic heater. It is also possible to use other known heating means, such as an electromagnetic induction coil, a halogen heater, and an infrared lamp, for internally or externally heating the heating member. It is also possible to employ a fixing device constitution such that also the pressing member is heated.

4) It is also possible to employ a fixing device constitution such that the pressure at the nip is in the applied state by pressing only the pressing member or both the heating member and the pressing member by the member.

5) The image forming apparatus may also be an image forming apparatus other than the color electrophotographic printer in the embodiment, a monochromatic copying machine, a facsimile machine, a monochromatic printer, a multi-function machine having functions of these machines, and the like. That is, the constitutions of the fixing device and the color electrophotographic printer in the embodiment are not limited to combinations of the above-described constituent members, and may also be realized in other embodiments in which a part or all of the constituent members are replaced with alternative members thereof, respectively.

6) The image forming type of the image forming apparatus is not limited to the electrophotographic type. The image forming device may also be of an electrostatic recording type or a magnetic recording type. Further, the transfer type is also not limited, but such a constitution that the image is directly formed on the sheet such as electro-facsimile paper, electrostatic recording paper or plain paper may also be employed. It is also possible to use a type in which an image is formed on the sheet by an ink jet type and then is fixed on the sheet by heat drying.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 107915/2013 filed May 22, 2013, which is hereby incorporated by reference.

What is claimed is:

1. An image forming apparatus comprising:

an image forming device configured to form a toner image on a sheet;

a fixing unit, including first and second rotatable members configured to form a nip, configured to fix the toner image formed on the sheet by said image forming device;

a mounting portion to which said fixing unit is detachably mountable substantially along a longitudinal direction thereof;

a movable pressing portion configured to move said first rotatable member toward said second rotatable member at a pressing position;

a moving mechanism configured to move said pressing portion along a direction substantially perpendicular to the longitudinal direction toward the pressing position in a space of said mounting portion through which said fixing unit passes during mounting and demounting; and a retracting mechanism configured to retract said pressing portion from the pressing position to an outside of the space.

2. An image forming apparatus according to claim 1, further comprising a guide mechanism configured to guide slide movement of said fixing unit during the mounting and demounting of said fixing unit.

3. An image forming apparatus according to claim 2, wherein the slide movement is linear movement.

4. An image forming apparatus comprising:

an image forming device configured to form a toner image on a sheet;

a fixing unit, including first and second rotatable members configured to form a nip, configured to fix the toner image formed on the sheet by said image forming device;

a mounting portion to which said fixing unit is detachably mountable substantially along a longitudinal direction thereof;

a pressing portion configured to generate a pressing force between said first rotatable member and said second rotatable member, said pressing portion being movable between a first position in a space of said mounting portion through which said fixing unit passes during mounting and demounting and a second position outside the space, wherein at the first position, said pressing portion generates the pressing force; and a moving mechanism configured to move said pressing portion between the first position and the second position along a direction substantially perpendicular to the longitudinal direction.

5. An image forming apparatus according to claim 4, further comprising a guide mechanism configured to guide slide movement of said fixing unit during the mounting and demounting of said fixing unit.

6. An image forming apparatus according to claim 5, wherein the slide movement is linear movement.

7. An image forming apparatus comprising:

an image forming device configured to form a toner image on a sheet;

a fixing unit, including first and second rotatable members configured to form a nip, configured to fix the toner image formed on the sheet by said image forming device;

a mounting portion to which said fixing unit is detachably mountable substantially along a longitudinal direction thereof;

a movable pressing portion configured to move said first rotatable member toward said second rotatable member at a pressing position;

a moving mechanism configured to move said pressing portion along a direction substantially perpendicular to the longitudinal direction toward the pressing position where said pressing portion overlaps with said fixing unit when said fixing unit mounted in said mounting portion is viewed along the longitudinal direction; and a retracting mechanism configured to retract said pressing portion from the pressing position so as not to overlap with said fixing unit when said fixing unit mounted in said mounting portion is viewed along the longitudinal direction.

8. An image forming apparatus according to claim 7, further comprising a guide mechanism configured to guide slide movement of said fixing unit during the mounting and demounting of said fixing unit.

9. An image forming apparatus according to claim 8, wherein the slide movement is linear movement.

10. An image forming apparatus comprising:

an image forming device configured to form a toner image on a sheet;

a fixing unit, including first and second rotatable members configured to form a nip, configured to fix the toner image formed on the sheet by said image forming device;

a mounting portion to which said fixing unit is detachably mountable substantially along a longitudinal direction thereof;

a pressing portion configured to generate a pressing force between said first rotatable member and said second rotatable member, said pressing portion being movable between a first position where said pressing portion overlaps with said fixing unit when said fixing unit mounted in said mounting portion is viewed along the longitudinal direction and a second position where said pressing portion does not overlap with said fixing unit when said fixing unit mounted in said mounting portion is viewed along the longitudinal direction, wherein at the first position, said pressing portion generates the pressing force; and a moving mechanism configured to move said pressing portion between the first position and the second position along a direction substantially perpendicular to the longitudinal direction.

11. An image forming apparatus according to claim 10, further comprising a guide mechanism configured to guide slide movement of said fixing unit during the mounting and demounting of said fixing unit.

12. An image forming apparatus according to claim 11, wherein the slide movement is linear movement.

* * * * *